United States Patent [19]

Heynisch et al.

[11] Patent Number: 4,539,512

[45] Date of Patent: Sep. 3, 1985

[54] TRAVELING-WAVE TUBE WITH PERIODIC PERMANENT-MAGNET FOCUSSING SYSTEM

[75] Inventors: Hinrich Heynisch, Gräfelfing; Eckart Schmid, Munich, both of Fed. Rep. of Germany

[73] Assignee: Siemens Aktiengesellschaft, Berlin and Munich, Fed. Rep. of Germany

[21] Appl. No.: 489,507

[22] Filed: Apr. 28, 1983

[30] Foreign Application Priority Data

Apr. 30, 1982 [DE] Fed. Rep. of Germany ..... 3216250

[51] Int. Cl.[3] ..... H01J 23/08

[52] U.S. Cl. ..... 315/5.35; 335/210; 315/3.5; 315/3.6

[58] Field of Search ..... 315/5.35, 3.6, 3.5; 335/210

[56] References Cited

U.S. PATENT DOCUMENTS

| | | | |
|---|---|---|---|
| 3,398,315 | 8/1968 | Washburn | 315/5.35 |
| 3,755,706 | 8/1973 | Scott | 315/5.35 |
| 3,958,147 | 5/1976 | Triplett | 315/5.35 |
| 4,041,349 | 8/1977 | Davis | 315/5.35 |
| 4,137,482 | 1/1979 | Caryotakis et al. | 315/5.35 |
| 4,404,494 | 9/1983 | Heynisch | 315/5.35 |

*Primary Examiner*—Saxfield Chatmon

*Attorney, Agent, or Firm*—Herbert L. Lerner; Laurence A. Greenberg

[57] ABSTRACT

A traveling-wave tube having a cylindrical vacuum envelope surrounded by a permanent-magnet system of ring-shaped pole washers and magnet rings respectively disposed therebetween and having opposite polarizations alternatingly in axial direction, which includes spacer rings formed of nonmetallic material surrounding the cylindrical vacuum envelope and spacing the magnet rings therefrom, corresponding magnet rings and spacer rings being soldered together into respective strong and stable units.

2 Claims, 1 Drawing Figure

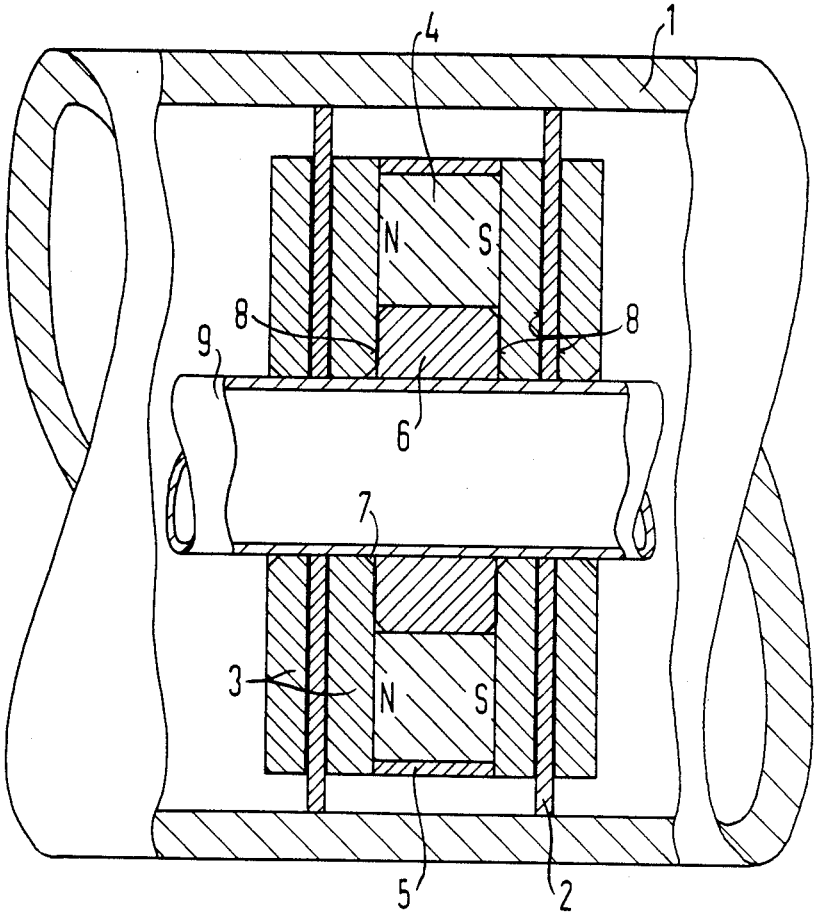
4
1
N
S
8
8
9
6
7
3
N
S
5
2

TRAVELING-WAVE TUBE WITH PERIODIC PERMANENT-MAGNET FOCUSSING SYSTEM

The invention relates to a traveling-wave tube with a periodic permanent-magnet focussing system and, more particularly, to such a tube having a cylindrical vacuum envelope surrounded by a permanent magnet-system of ring-shaped pole washers and magnet rings respectively disposed therebetween and having opposite polarizations alternatively in axial direction.

A traveling-wave tube with such a permanent-magnet system is known from U.S. Pat. NO. 4,137,482 and from German Published Prosecuted Application No. (DE-AS) 21 19 817.

This system is also called a PPM system (Periodic Permanent-Magnet Focussing System). In PPM systems known heretofore, pole washers have been used which are centered on the vacuum envelope of the traveling-wave tube with a given amount of play. Extreme parallelism had to be maintained simultaneously by the ring magnets as well as by the pole washers. This system consequently presents difficulties with respect to alignment or balancing function i.e. considerable expense in time required in manufacture as well as with respect to mechanical-thermal stability during operation of the traveling-wave tube.

In a periodic permanent-magnet focussing system for traveling-wave tubes, the problem exists of providing a series or line of alternating magnetic fields which can readily be aligned or balanced on the tube. In spite thereof, stable behavior of the entire mechanical structure must be assured even in the event of relatively high thermal stresses and, in fact, under continuous as well as alternating stress. Also, connection or plug-and-socket technology heretofore has had problems with fitting tolerances.

It is accordingly an object of the invention to provide a stable PPM system for an integrated traveling-wave tube.

With the foregoing and other objects in view, there is provided, in accordance with the invention, a traveling-wave tube having a cylindrical vacuum envelope surrounded by a permanent-magnet system of ring-shaped pole washers and magnet rings respectively disposed therebetween and having opposite polarizations alternatingly in axial direction, including spacer rings formed of nonmagnetic material surrounding the cylindrical vacuum envelope and spacing the magnet rings therefrom, corresponding magnet rings and spacer rings being soldered together into respective strong and stable units.

In accordance with another feature of the invention, there is provided a respective heat removing washer disposed between adjacent pairs of the pole washers.

In accordance with an additional feature of the invention the pole washers are formed with a central opening, respectively, formed at an inner edge thereof with a bevel having a given optimum angle.

In accordance with a concomitant feature of the invention, there is provided a cylinder surrounding the magnet rings.

Other features which are considered as characteristic for the invention are set forth in the appended claims.

Although the invention is illustrated and described herein as embodied in a traveling-wave tube with periodic permanent-magnet focussing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing, which is a diagrammatic cross-sectional view of the traveling-wave tube with a periodic permanent-magnet focussing system.

In the drawing, those parts of the tube which do not contribute positively to an understanding of the invention have been omitted.

In the FIGURE, there is shown purely diagrammatically a portion of a vacuum envelope of a traveling-wave tube with a periodic permanent-magnet focussing system arranged around it.

The vacuum envelope 9 is cylindrical and is surrounded by a permanent-magnet system formed of pole washers or discs 3 and magnet rings 4 which are arranged therebetween and are, alternatingly in axial direction polarized in opposite directions. Between the vacuum envelope 9 and the magnet ring 4 there is disposed a respective spacer ring 6 of nonmagnetic material. In this illustrated embodiment of the invention respective heat removal discs or washers 2, which are formed preferably of copper and extend to a heat removal cylinder 1, are arranged between the pole discs or washers 2. Advantageously, the heat removal cylinder 1 is likewise formed of copper or a similar material with a high heat-removal or heat-dissipation capacity. The magnet rings 4 are surrounded on the outside thereof by a cylinder 5 for temperature compensation of the magnetic field. The pole washers are formed with beveled edges 7 at the inner circumference thereof which provide better rotational or axial symmetry of the magnetic field and are simultaneously effective as a solder stopper or control. Vacuum-tight solder joints 8 are provided between the pole washers 3 and both the heat removal washers 2 are the spacer rings 6. The pole washers 3 are formed of magnetic soft iron and the spacer rings 6 of a nickel-chrome alloy or of bronze, a nonmagnetic steel and of copper-nickel alloys, respectively.

The invention also affords an advantage that, by using pole washers or discs 3, much simpler manufacture is possible. Furthermore, the invention permits joining or connecting of pole washers 3, for example formed of iron, and heat removal washers 2, for example formed of copper.

It is also noted that be beveling the edges of the pole washers at an optimum angle at the interior opening formed therein, an advantageous homogenization of the magnetic field is achieved.

The foregoing is a description corresponding in substance to German Application No. P 32 16 250.2, dated Apr. 30, 1982, the International priority of which is being claimed for the instant application, and which is hereby made part of this application. Any material discrepancies between the foregoing specification and the aforementioned corresponding German application are to be resolved in favor of the latter.

We claim:

1. Traveling-wave tube having a cylindrical vacuum envelope surrounded by a permanent-magnet system of ring-shaped pole washers and magnet rings respectively disposed therebetween and having opposite polarizations alternatingly in axial direction, comprising spacer rings formed of nonmagnetic material surrounding the cylindrical vacuum envelope and spacing the magnet rings therefrom, corresponding magnet rings and spacer rings being soldered together into respective strong and stable units and respective heat removing washers disposed between adjacent pairs of the pole washers.

2. Traveling-wave tube according to claim 1, including a cylinder surrounding the magnet rings for temperature compensation of the magnetic field of the magnet rings.

* * * * *